United States Patent [19]

Endo et al.

[11] Patent Number: 4,549,472

[45] Date of Patent: Oct. 29, 1985

[54] REARRANGEABLE PARTIAL ENVIRONMENTAL CONTROL DEVICE

[75] Inventors: Mitsushi Endo, Hadano; Toshiaki Taniguchi, Hiratsuka; Teruyoshi Sahara, Hadano; Noriyuki Hayakawa, Odawara; Tatsuo Yoshitomi; Kozo Takahashi, both of Niigata; Yoshiteru Nagatani, Iruma; Hidenao Kawai, Noda; Shuichi Kaizyo, Chigasaki; Yoichi Nakagawa, Gyoda; Kazuo Yamagami, Yokohama; Teruo Takizawa, Chigasaki; Tomio Suzuki, Tokyo, all of Japan

[73] Assignees: Hitachi Ltd.; Hitachi Plant Engineering & Construction Co., both of Tokyo, Japan

[21] Appl. No.: 580,387

[22] Filed: Feb. 15, 1984

[30] Foreign Application Priority Data

Sep. 29, 1983 [JP] Japan ..... 58-181345

[51] Int. Cl.[4] ..... F24F 7/06

[52] U.S. Cl. ..... 98/34.6; 55/385 A; 98/31.5; 98/40.1

[58] Field of Search ..... 55/385 A; 98/33 R, 33 A, 98/36, 40 D, 115 R, 115 LH

[56] References Cited

U.S. PATENT DOCUMENTS

| | | | |
|---|---|---|---|
| 3,115,819 | 12/1963 | Mahlmeister et al. | 98/33 A X |
| 3,367,257 | 2/1968 | Raider et al. | 98/40 D X |
| 3,522,724 | 8/1970 | Knab | 98/40 D X |
| 3,730,072 | 5/1973 | Soderlund et al. | 98/40 D |
| 3,975,995 | 8/1976 | Shuler | 98/40 D |
| 3,986,850 | 10/1976 | Wilcox | 98/115 LH X |
| 4,284,236 | 8/1981 | Bradshaw | 98/115 R |
| 4,344,784 | 8/1982 | Deckas et al. | 98/40 D X |
| 4,377,059 | 3/1983 | Kuhr | 98/40 D X |

FOREIGN PATENT DOCUMENTS

| | | | |
|---|---|---|---|
| 58-127033 | 7/1983 | Japan | 98/36 |

*Primary Examiner*—Harold Joyce

*Attorney, Agent, or Firm*—Birch, Stewart, Kolasch & Birch

[57] ABSTRACT

The present invention relates to an air-conditioning and an environmental control device for manufacturing plants of integrated circuits, chemicals and foods, hospitals, etc. where clean air is required. In this environmental control device, controlled air blows out from one side and is absorbed into the other side of the room. The blowing surface and the absorbing surface are divided on the basis of the predetermined module. Ventilating units are formed in a suitable size to conform to the module. Because of the construction, the controlling system of temperature or cleanliness of the air in the environmental control room can be rearranged to an optional one by replacing or changing positions of the ventilating units. Even if a controlling system is rearranged to an optional one, the room should be divided into a supply chamber, a mixing chamber, an environmental control chamber and a return chamber from one side to the opposite side of the room, so that air conditioned can flow as required. Conditioned air enters the supply chamber, and air from the supply chamber and air from the return chamber are mixed in the mixing chamber. The mixed air passes through the ventilating units contained in the mixing chamber to be supplied into the environmental control chamber. The ventilating units have a fan and a high efficiency particulate air (HEPA) filter.

5 Claims, 11 Drawing Figures

REARRANGEABLE PARTIAL ENVIRONMENTAL CONTROL DEVICE

BACKGROUND OF THE INVENTION

1. Field of the Invention

The present invention relates to a rearrangeable partial environmental control device, and more specifically to a rearrangeable partial environmental control device suitable for use in air conditioned clean rooms for manufacturing plants of semiconductors, computers, chemicals and foods, in hospitals, laundry rooms for cleaning garments, etc.

2. Description of the Prior Art

As a conventional air conditioned clean room, a ductless air conditioned clean room and an air conditioned clean room with a duct have been known.

In the air conditioned clean room, the temperature and humidity of the outside air drawn in by a fan are controlled by an adjustor.

The air passes through a prefilter to be supplied into ventilating units after being supplied from a air drawing chamber via a supply duct or directly from a supply duct. In general, the ventilating units are provided right above the working areas, the manufacturing equipments or products where cleanliness, temperature and humidity control is required. Consequently, when the working areas or the manufacturing equipment placed in an air conditioned, dustless room need to be rearranged, the positions of the ventilating units should also be rearranged. Enormous cost and time are required for dismantling and reinstalling a supply duct or a ceiling. Moreover, during the reconstruction period, production is stopped, adjacent equipment and manufacturing lines are affected and dust produces a bad influence. Even after reconstruction work is completed, many days are required for recleaning the area. These problems constitute a hindrance to production efficiency. In such ventilating units, a fan and a filter should be removed from a casing of the ventilating units at each maintenance inspection. Especially the filter should be periodically replaced to maintain the cleanliness of a room. To replace a fan or filter of the conventional ventilating units, however, workers must do their work near the ceiling, and much time is required for the work. Moreover, such work produces dust and it takes a long time before a stable clean area is recovered.

SUMMARY OF THE INVENTION

It is an object of the present invention to offer a rearrangeable partial environmental control device in which ventilating units can be mounted, removed or moved in rearranging work areas or the manufacturing equipment in the environmental control room.

A further object of the invention is to offer ventilating units which are easily dismantled and allows replacing a fan or a filter from the side of the environmental control room.

In order to achieve the above objects, a room is divided into a supply chamber, a mixing chamber, an environmental control chamber and a return chamber from one side of the room to the opposite side, and each chamber is partitioned by a lattice. The first lattice is provided between the supply chamber and mixing chamber. The second lattice is provided between the mixing chamber and the environmental control chamber, and the third lattice is provided between the environmental control chamber and the return chamber.

The first lattice has lids or openings in its spaces. Ventilating units or lids are removably mounted in the spaces of the second lattice. Absorbing boards to absorb air into the return chamber from the environmental control chamber or lids are removably provided in the spaces of a third lattice. A detector is installed at the predetermined position in the environmental control chamber and makes a signal to control the air flow supply of ventilating units and/or absorption ratio of conditioned air from the supply chamber and return air. The ventilating units are removably mounted on the second lattice from the side of the environmental control chamber. The ventilating units have a fan, diffusing vanes, and a filter, which are arranged in this order from the air inlet toward the air outlet in the casing and are removable from the side of the environmental control chamber.

DETAILED DESCRIPTION OF THE INVENTION

Figure 1:
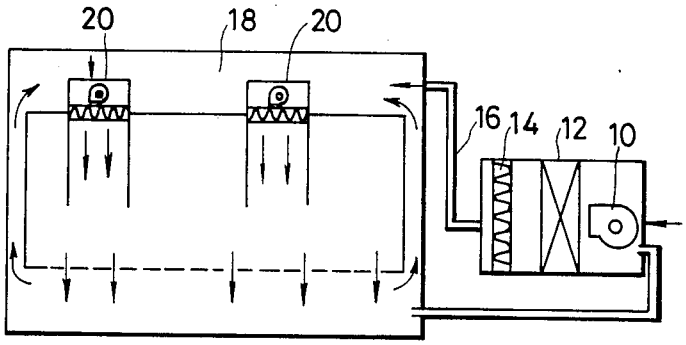
FIG. 1 PRIOR ART
FIGS. 1 and 2 illustrate the structure of the conventional air conditioned clean room.
Figure 2:
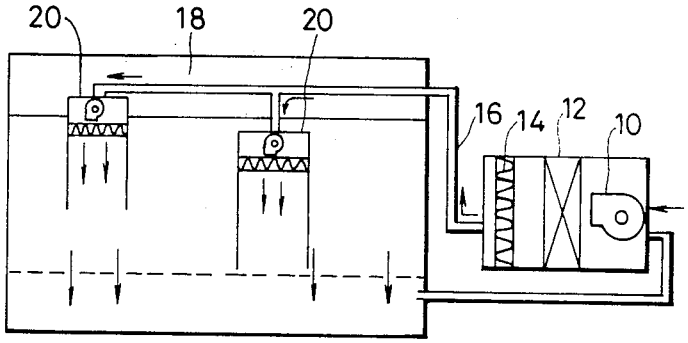
FIG. 2 PRIOR ART

FIG. 1 and FIG. 2 illustrate the construction of a conventional air conditioned clean room. FIG. 1 illustrates a ductless air conditioned clean room, and FIG. 2 illustrates an air conditioned clean room with a duct. In these figures, temperature and humidity of outside air drawn in by a fan 10 are controlled by an adjustor 12. The air passes through a prefilter 14 to be supplied into ventilating units 20 after being supplied into an air drawing chamber 18 via a supply duct 16 (FIG. 1) or directly from a supply duct 16 (FIG. 2). In general, the ventilating units are provided right above the working areas, manufacturing equipment or products where cleanliness, temperature and humidity control is required.

Figure 3:
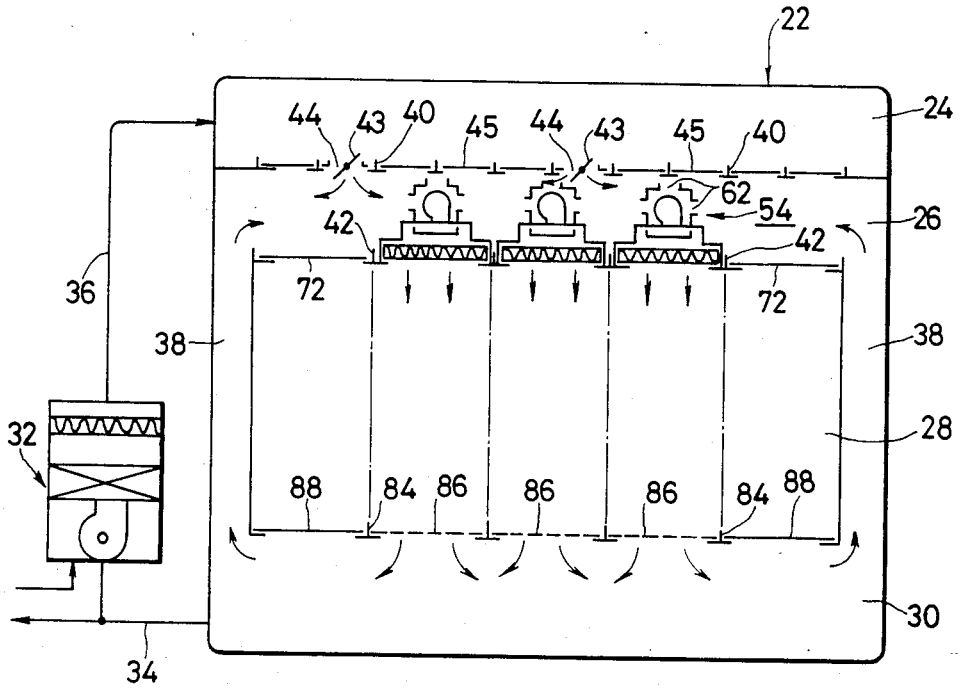
FIG. 3 illustrates the structure of the vertical type rearrangeable partial environmental control device of the present invention.

A preferred embodiment of a rearrangeable partial environmental control room of the present invention will be described in detail with use of attached drawings (FIGS. 3–10). FIG. 3 shows the construction of a vertical type partial environmental control room wherein a supply chamber 24, a mixing chamber 26, an environmental control chamber 28 and a return chamber 30 are arranged from the top to the bottom of the room 22. An air conditioner 32 absorbs a part of air of the return chamber 30 via a duct 34 together with outside air, and, after conditioning, it supplies air to the supply chamber 24 via a duct 36. The sides of the environmental control chamber 28 are in double wall construction, having a passage 38, through which most of air in the return chamber 30 is sent to the mixing chamber 26.

Figure 4:
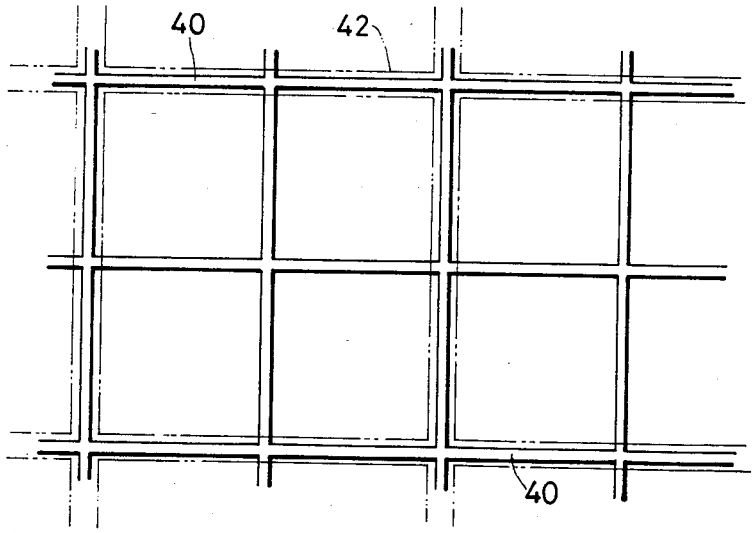
FIG. 4 illustrates the arrangement of a lattice of the partial environmental control device illustrated in FIG. 3.

A lattice 40 constructed as shown in FIG. 4 is provided between the supply chamber 24 and the mixing chamber 26, and a lattice 42 is arranged between the mixing chamber 26 and the environmental control chamber 28. The lattice 42 is constructed with a pitch double that of the lattice 40, and the frame of the lattice 42 is arranged so as to correspond to the frame of the lattice 40. Opening 44 with dampers 43 are mounted in the spaces of the lattice 40 and the remaining spaces are closed by the lids 45. Ventilating units 54 and lids 72 are mounted in the spaces of the lattice 42.

Figure 5:
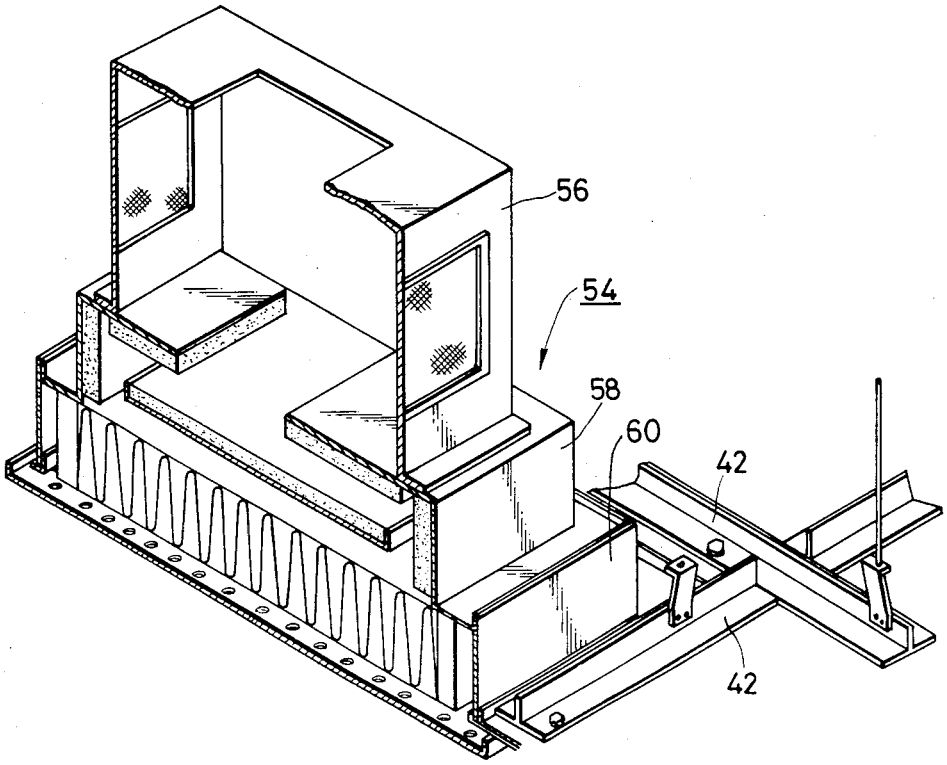
FIG. 5 is a perspective view, partly in cross section, illustrating the ventilating unit of the partial environmental control device.

A ventilating unit 54 shown in FIG. 5 (a fan is not illustrated) is installed at proper positions in the spaces of the lattice 42. The ventilating unit 54 consist of a rectangular fan case 56, diffusing chamber 58 arranged at the lower part (outlet side) of the fan case 56 and a filter case 60 arranged at the lower part (outlet side) of the diffusing chamber 58.

Figure 6:
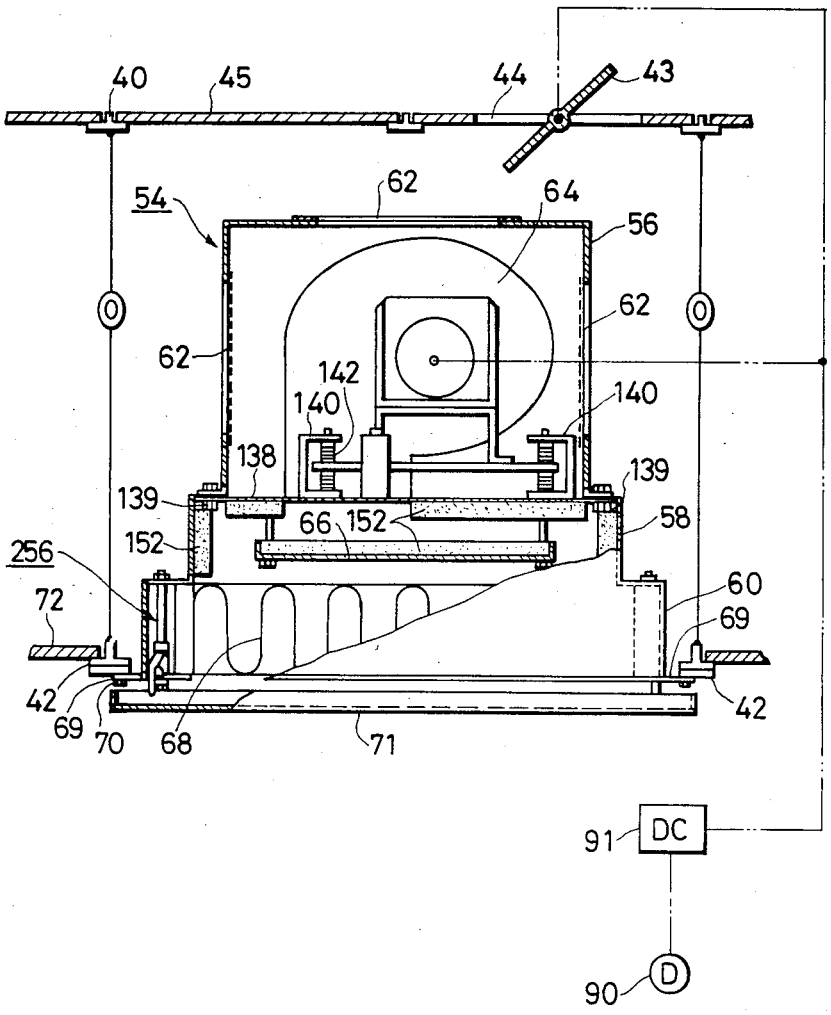
FIG. 6 is a cross-sectional view illustrating the inner structure of the ventilating unit.

In FIG. 6, air inlets 62 are formed on the upper surface and sides of the fan case 56 wherein a fan 64 is installed. Inside the diffusing chamber 58, a diffusing vane 66 is arranged opposite to the outlet of the fan 64 so that air from the fan 64 is uniformly supplied onto the whole surface of the high efficiency particulate air (HEPA) filter 68. A mounting board 69 of the ventilating units 54 is mounted to the lattice 42 by fastening bolts 70 to the lattice 42. In this way, the ventilating units 54 can be removably mounted at predetermined positions of the lattice 42 with bolts 70 from the side of the environmental control chamber 28. Fan 64 is supported by fan supporting board 138 via vibration-proof springs 142 and brackets 140 and fastened to the fan case 56 with bolts 139. The diffusing vanes 66 hang from the fan supporting board 138. The upper surface of the diffusing vanes 66 and inner surfaces of diffusing chamber 58 are covered with material of noise absorber 152 to decrease noise from the fan and the air passage. Filter 68 can be easily mounted or removed from below with fixtures 256.

Figure 7:
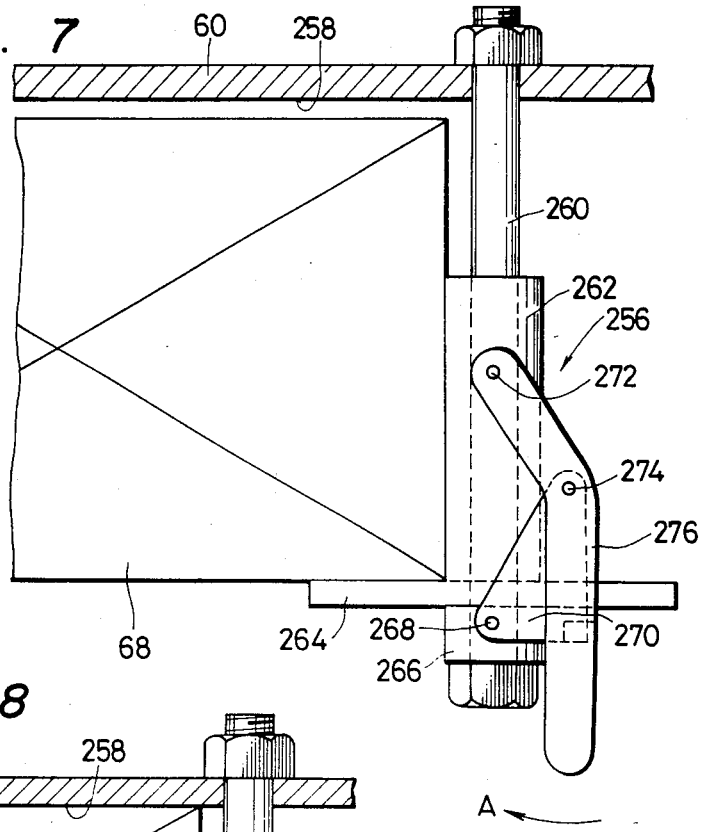
FIGS. 7 and 8 are detailed drawings of a fixture for mounting a filter of the ventilating unit.
Figure 8:
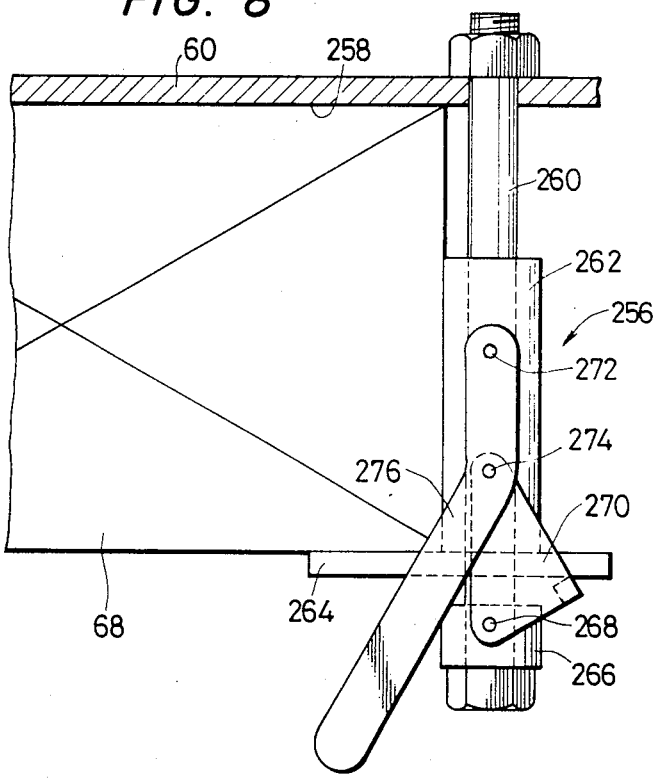

FIGS. 7 and 8 are detailed drawings of the fixtures 256 for filter 68, which consist of a bolt 260 fastened on the upper surface 258 of the filter case 60, an upper pipe 262 movably fitted to the bolt 260, a supporting plate 264 fastened at the lower end of the upper pipe 262, a lower pipe 266 movably fitted to the bolt 260, forked bracket 270 one end of which is rotatably fastened to both sides of the lower pipe 266 with a pin 268 and a lever 276 rotatably fastened to the upper pipe 262 by a pin 272 and, at the same time, to the other end of the forked bracket 270 by a pin 274. The filter 68 is mounted on the filter case 60 in the following way: the supporting plate 264 is withdrawn from the inserting region of the filter 68 by rotating the fixture 256 and the filter 68 is inserted into the filter case 60. Next, the filter 68 is supported by the supporting plate 264 as shown in FIG. 7 by rotating back the fixture 256 to the original position. When a lever 276 is pushed in the direction denoted by an arrow A in FIG. 7, pins 268, 274 and 272 come into almost a straight line, the upper pipe 262 and the supporting plate 264 moves upward and pushes the filter 68 to be set within the filter case 60. The filter 68 can be removed by the reverse operation of the above-mentioned process. Four corners of the filter are supported by the fixtures 256. Punching plate 71 is fixed to the lower end of the fixture 256, as shown in FIG. 6.

Conventionally, the replacement of filters requires much time and produces much dust, because they are fastened with bolts. In general, the relationship between human movement and produced dust particles (particle number/min) is as follows: several scores of particles/min at the state of repose, several thousands of particles/min produced by light movement, and several hundreds of thousands of particles/min produced by active movement. Accordingly, with the present embodiment in which the filter 68 and the punching plate 71 can be removed by a single operation, in a couple of minutes, the amount of dust is extremely small and the predetermined cleanliness of the environmental control chamber 28 can be recovered in a short time.

The opening angle of the dampers 43 and air supply amount of the fan 64 are controlled by a signal controller 91 corresponding to values of cleanness, temperature, humidity, gas concentration, number of bacteria, etc. of air detected by a detector 90 arranged in the environmental control chamber 28.

Figure 9:
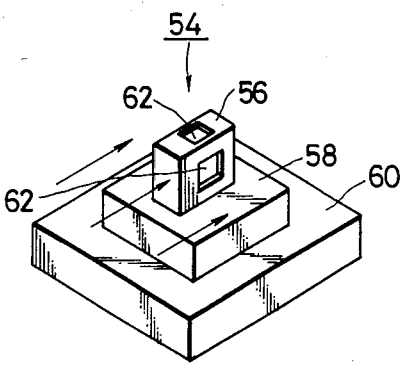
FIGS. 9 and 10 are perspective views illustrating arrangements of the ventilating unit.
Figure 10:
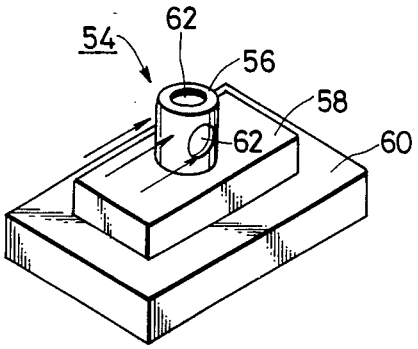

The ventilating units 54 are formed with a narrow width in the transverse direction of air flow in the mixing chamber 26, as shown in FIG. 9 and FIG. 10. The diffusing chamber 58 is formed with a narrower width than the filter case 60, and the fan case 56 is formed with a narrower width than the diffusing chamber 58. In this way, the resistance of flowing air in the mixing chamber 26 decreases.

In FIG. 3 again, the environmental control chamber 28 and the return chamber 30 are divided by the lattice 84, which is used as a floor. In the spaces of the lattice 84, opposite to the ventilating units 54, grilles 86 are removably installed as air absorbing boards, and other spaces are closed with removable lids 88.

The process of the present embodiment constructed as described above is as follows:

Conditioned air is supplied to the supply chamber 24 via a duct 36 from the air conditioner 32. When fans 64 of the ventilating units 54 are operated, the pressure in the mixing chamber 26 becomes lower than that of the return chamber 30. Consequently, the air in the return chamber 30 is directed through the air passages 38 into the mixing chamber 26, wherein the air is mixed with the conditioned air from the supply chamber 24. The ventilating units 54 are arranged on the predetermined positions of the lattice 42 as required. The ventilating units 54 can form an air-conditioned dustless zone if necessary. In the air-conditioned dustless zone, the air absorption ratio from the supply chamber 24 and the mixing chamber 26 can be varied by changing opening angles of the dampers 43 to control cleanliness, temperature and humidity of the air as required.

The ventilating units 54 are removably installed on the lattice 42 in the above-mentioned embodiment, so they can be easily moved and rearranged without requiring large-scale construction work. Moreover, according to the present embodiment, partial air conditioning can be carried out in the environmental control chamber 28, so the optimum air conditioning is attainable without losing balance of air condition of the whole environmental control chamber 28 which has a heat source, such as an electric furnace. A mixing chamber 26 is arranged between the supply chamber 24 to which conditioned air is supplied from the air conditioner 32 and the environmental control chamber 28, so the noise from the air conditioner 32 does not reach the environmental control chamber 28. The mixing chamber 26 is adjacent to the supply chamber 24, so heat is transferred from air in the supply chamber 24 to air in the mixing chamber 26, which helps save energy of air conditioning. Moreover, the environmental control chamber 28 is surrounded by the mixing chamber 26, the return chamber 30 and the passages 38 in double wall construction, having lower pressure than the environmental control chamber 28, so heat is hard to transfer from the environmental control chamber 28 to the outside air, and dust is difficult to diffuse into the environmental control chamber 28.

As the fan 64 is positioned in the mixing chamber 26, the pressure in the mixing chamber 26 is lower than that in the environmental control chamber 28. As a result, dust does not fall down into the environmental control chamber 28 from the mixing chamber 26.

Figure 11:
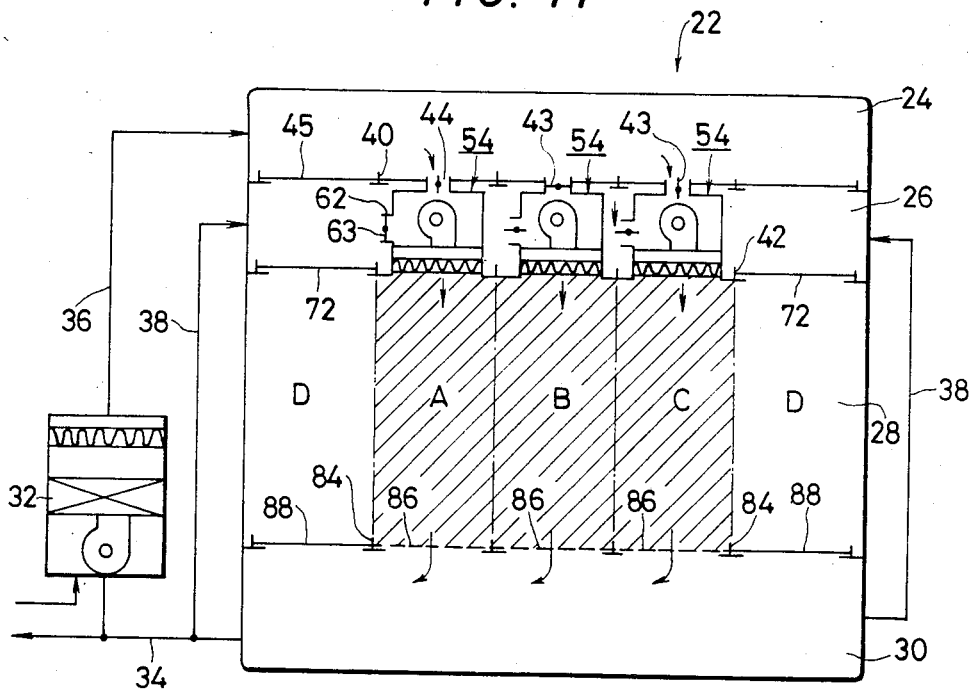
FIG. 11 illustrates the structure of another rearrangeable partial environmental control device of the present invention.

FIG. 11 illustrates another embodiment wherein lattices 40, 42, and 84 dividing the supply chamber 24, the mixing chamber 26, the environmental control chamber 28 and the return chamber 30 correspond to each other. Air inlets 62 on the sides of the ventilating units 54 have return air dampers 63, and air inlets 62, fronting on the supply chamber 24, have openings 44 where dampers 43 are arranged.

The ventilating units 54 can form an air-conditioned zone A, a dustless zone B and an air-conditioned dustless zone C according to the requirements of manufacturing facilities. In the air-conditioned dustless zone C, the air absorption ratio between the supply chamber 24 and the mixing chamber 26 can be varied by changing the opening angles of dampers 43, and 63. Cleanness, temperature and humidity of the air can also be varied as required. In the figure, D is an uncontrolled zone.

The environmental control chamber of the present embodiment is suitable to be adopted in the presence of sources of partially high heat, gas or dust.

The present invention has been described regarding the case of vertical arrangement of the supply chamber 24, the mixing chamber 26, the environmental control chamber 28 and the return chamber 30, where air flows downward, but it is also applicable in the case when ventilating units are mounted on the side wall to direct air in the horizontal direction. The horizontal type does not require remodeling work of the ceiling, etc., so it is advantageous to be installed in existing buildings.

As described above, with the rearrangeable partial environmental control chamber according to the present invention, a room is divided into a supply chamber, a mixing chamber, an environmental control chamber, and a return chamber from the one side to the opposite side of the room. A first lattice having openings is arranged between the supply chamber and the mixing chamber. The second lattice is arranged between the mixing chamber and the environmental control chamber, and the third lattice is arranged between the environmental control chamber and the return chamber. Ventilating units can be removably installed at optional positions of the second lattice, so conditions of cleanliness, temperature and humidity of the air in the environmental control chamber can be partially changed. Moreover, as ventilating units can easily be installed on or removed from the second lattice, it is possible to transfer ventilating units without dismantling or remodeling ceilings, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A rearrangeable partial environmental control device wherein a room is divided into a supply chamber connected to a air conditioner, a mixing chamber, an environmental control chamber and a return chamber, which is connected to said mixing chamber, from one side to the opposite side of said room, said control device comprising in combination a first lattice with spaces arranged between said supply chamber and said mixing chamber, a second lattice with spaces arranged between said mixing chamber and said environmental control chamber, a third lattice with spaces arranged between said environmental control chamber and said return chamber, ventilating units removably installed in a number of said spaces of said second lattice, lids removably mounted in remaining spaces of said second lattice, absorbing boards removably provided in a number of spaces of said third lattice to absorb air from said environmental control chamber into said return chamber and lids removably mounted in remaining spaces of said third lattice, conditioned air from said supply chamber and circulating air from said return chamber being mixed in said mixing chamber and air from said ventilating units being blown to predetermined positions of said environmental control chamber.

2. The rearrangeable partial environmental control device of claim 1, wherein said ventilating units have a filter case with an air inlet and a diffusing chamber with an inlet arranged on said air inlet side of said filter case having a narrower width than that of said filter case and a fan case arranged on said air inlet side of said diffusing chamber and formed with a narrower width than that of said diffusing chamber.

3. The rearrangeable partial environmental control device of claim 1, wherein said first lattice is formed in lattice work of which some spaces are provided with dampers and remaining spaces are closed with lids.

4. The rearrangeable partial environmental control device of claim 1, wherein air from said ventilating units is blown to predetermined positions of said environmental control chamber controlled by a detector which makes signals to control the air supply in said ventilating units and/or the air absorption ratio of conditioned air from said supply chamber and circulating air from said return chamber.

5. The rearrangeable partial environmental control device of claim 1, wherein casings of said ventilating units are removably mounted on said second lattice from said environmental control chambers side, and a fan, diffusing vanes and a filter can be successively arranged in said casing from said side of said environmental control member.

* * * * *